US006817727B1

(12) United States Patent
McFadden

(10) Patent No.: US 6,817,727 B1
(45) Date of Patent: Nov. 16, 2004

(54) DEVICE FOR AIDING DETECTION OF SUBMERGED BODY

(76) Inventor: Gary W. McFadden, 5730 Carthage Ave., Cincinnati, OH (US) 45212

( * ) Notice: Subject to any disclaimer, the term of this patent is extended or adjusted under 35 U.S.C. 154(b) by 0 days.

(21) Appl. No.: 10/331,893

(22) Filed: Dec. 31, 2002

(51) Int. Cl.[7] ..... F21V 21/108
(52) U.S. Cl. ..... 362/108; 362/158; 362/267
(58) Field of Search ..... 362/108, 158, 362/267, 276, 800, 802, 101; 441/2, 7, 13, 16

(56) References Cited

U.S. PATENT DOCUMENTS 2,410,535 A * 11/1946 Van Daalen ..... 362/158
2,842,090 A * 7/1958 Samwald ..... 116/210
4,586,456 A * 5/1986 Forward ..... 116/210
4,796,167 A * 1/1989 Brown et al. ..... 362/158
4,834,684 A * 5/1989 Tallerino ..... 441/2
5,748,080 A * 5/1998 Clay ..... 340/539.26
6,527,605 B1 * 3/2003 Charte ..... 441/26

* cited by examiner

*Primary Examiner*—Y. My Quach-Lee
*Assistant Examiner*—Peggy A. Neils
(74) *Attorney, Agent, or Firm*—Neal O. Willmann

(57) ABSTRACT

Disclosed herein is a device to be worn by individuals engaged in any kind of maritime, coastal, inland-water or aquatic activity, so that in the event of a mishap, the body of the wearer can be more easily detected, even if submerged in dark or turbid water. The device contains an illumination means contained in a water-tight case that will disassociate from the body at a predetermined water pressure and float toward the surface while remaining tethered to the submerged body.

6 Claims, 1 Drawing Sheet

DEVICE FOR AIDING DETECTION OF SUBMERGED BODY

FIELD OF THE INVENTION

The disclosed invention relates generally to a device and method for the detection of a submerged body, typically a human body submerged in dark, murky or turbid waters. The device is designed to be worn by personnel or participants in any of a variety of maritime, coastal, inland-water or aquatic activities. The detection device will manifest utility in the event of a mishap where the individual or participant falls overboard or somehow enters the water, intentionally or unintentionally, and is either knocked unconscious or becomes unconscious and is unable to struggle or swim to the surface. Once the body is submerged, the device will "right" or align itself because of a buoyant end, illuminate and, once the body reaches a predetermined depth, disassociate from the body and float toward the surface while remaining tethered to the submerged body. The device will remain lighted and tethered for a reasonable length of time to provide an opportunity for searchers to retrieve, and perhaps revive, the body.

DESCRIPTION OF THE PRIOR ART

Disclosures somewhat relevant to the invention revealed herein include U.S. Pat. No. 5,921,656, which issued to Flood et al. Jul. 13, 1999. Flood et al. describe a hand-held, water activated strobe light to be used in rescue and emergency situations. It features a memory latch circuit that maintains activation of the light once the water activated switch comes in contact with water. U.S. Pat. No. 5,955,982, which issued to Moulin on Sep. 21, 1999, describes a method and device for guiding a rescue worker carrying a radio receiving device, at a standardized frequency, while searching for an avalanche victim wearing a radio transmitter device permanently transmitting a signal at the standardized frequency.

SUMMARY OF THE INVENTION

Notwithstanding the utility and cleverness of the devices described in the prior art publications, there remains an unmet need for a relatively simple device that can be worn unobtrusively on the belt or clothing of anyone working or recreating on or near oceans, lakes, streams or waterways. Such a device is disclosed herein and can be succinctly described as comprising the following elements:

- an illumination means;
- a power source in electrical communication with said illumination means;
- an invert switch to control the electrical communication between said power source and said illumination means; and
- a water-tight housing encasing said elements, said housing having a clasp engaged with a pressure-sensitive releasing means attachable to said individual and tethered to said water-tight housing by a line of predetermined length.

DESCRIPTION OF THE PREFERRED EMBODIMENT

Figure 1:
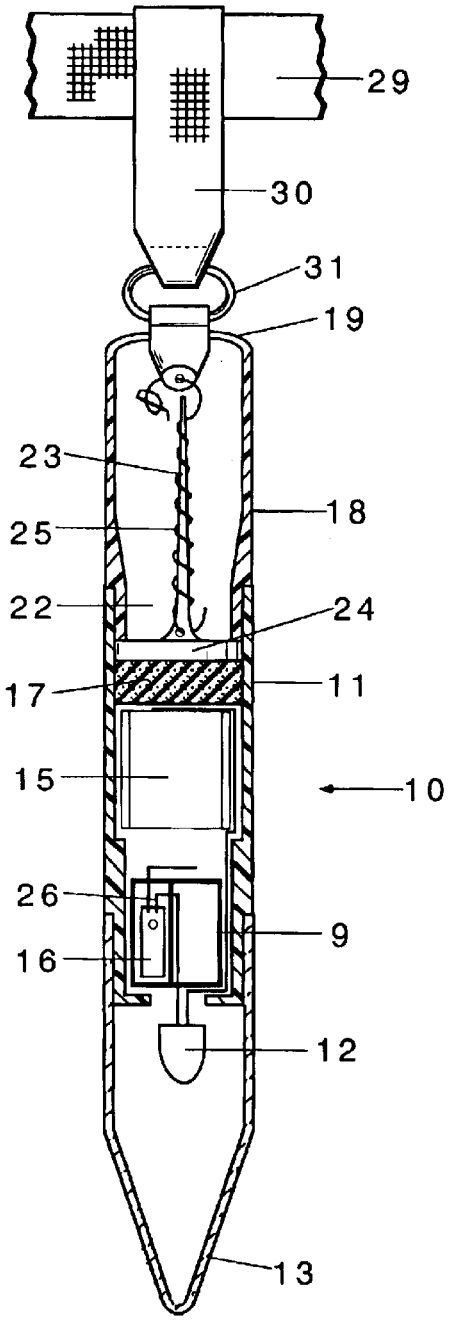
FIG. 1 is an elevated side view of a schematic depiction of the disclosed device in cross-section.

A full understanding and appreciation of the disclosed device and its method of use can be quickly obtained by referring to the drawing. FIG. 1 is an enlarged depiction of the disclosed device 10 in cross section. The housing 11 of the device 10 provides a water-tight compartment or environment for the functioning electrical elements. Those elements include an illumination means 12, which can be any of a variety of electrically activated, light emitting bulbs, and currently an LED, or light emitting diode, is performing more than adequately. The electric energy needed to power the LED is supplied by power source 14, which can be any of a variety of dry cell batteries commercially available. The batteries are conveniently situated in a battery housing 15. Presently, the power source 14 is a 3-volt lithium battery. The illumination means 12 and the power source 14 are, of course, in an electrical circuit 26, which is controlled by a tilt or invert switch 16 contained in switch housing 9. The invert switch is activated by gravity when the detection device 10 is tilted sufficiently to close an open circuit. A variety of invert switches are commercially available, either as the mercury switches frequently found in thermostats or as the tilt switch available from Fuji (models KON 204-30 and KOF 203-30. The purpose of the tilt switch is to close the circuit 26, permitting the activation of the LED, when the device 10 aligns itself in its buoyant orientation. Necessarily, that will be with the air-tight end of the device oriented toward the surface of the water. Typically, the buoyant orientation will be the opposite of, or 180° from the orientation assumed while worn.

The water-tight housing 11 of the device 10 necessarily contains air, in addition to the electrical elements. The air in the device will enable it to float, and when a person wearing the device enters the water and the device assumes its buoyant orientation, the tilt switch 16, will complete the circuit 26 and activate the LED, or other light emitting device deemed more appropriate.

Figure 2:
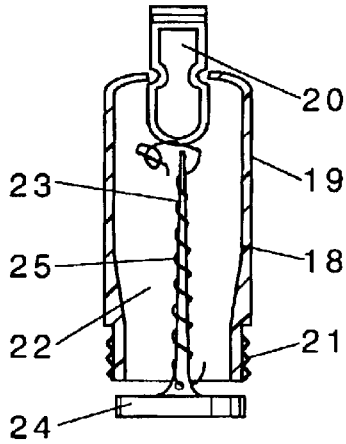
FIG. 2 is an elevated side view, in partial cross-section, of a schematic depiction of the pressure sensitive release mechanism that allows the disclosed device to disassociate from the submerged body at a predetermined pressure.

Also apparent from FIG. 1 is the latching means 19. The latching means 19 is preferably the distal end continuation of the water-tight housing 11. It is intended to function with the pressure sensitive latch release 20 (FIG. 2) and provide a housing 18 for the tether line 25. The latching means is associated with the pressure sensitive latch release 20 by means of a relatively snug friction fit. When a person wearing the device 10 enters water and is submerged to a predetermined depth, water pressure will compress the pressure sensitive latch release 20. When the latch release 20 is compressed, the latching means 19, attached to the latch release by only a snug friction fit, will disassociate from the latch release. The latch release remains secured to the submerged body, but attached to the disassociated latch release 20 is a tether line 25, which also remains attached to the disassociated latch means and the illuminated end of the device 10. As the illuminated water-tight housing 11 is allowed to float freely toward the surface of the water, it remains tethered to the submerged body.

The latch release means is currently an elastomeric pouch or bulb containing a small amount of silicone fluid. The silicone fluid is preferably more viscous than water, but a wide range of viscosities can be accommodated by adjusting the tenacity of the friction fit between the latch means and the latch release.

When being worn, the tether line 25 is stored neatly on the spindle 23 of a spool 22. To contain and protect the tether line during normal wear, it is preferably housed on its spool within the confines of the device 10 but it need not be in the water-tight compartment 11. Currently the spool and the line are situated within the confines of the line housing 18. As presently configured, the line housing 18 features the latching means 19 on its distal end. On its threaded proximal end 21, the line housing 18 threadably attaches to threads 27 on the water-tight housing 11. The tether line 25 is preferably a fine mono-filament line not unlike fishing line. Mono-filament line is easily obtainable and possesses strength properties belying its compact size and appearance. Not that it would be needed or required, but a 250 lb. test line is presently employed on the available prototypes. The length of the tether line has not been absolutely determined, but lengths between 3 and 20 meters would be more than sufficient for the intended use of the device. Typically, the latching means and latch release means will be adjusted to permit disassociation at water pressures associated with 3 to 10 meters of water.

Figure 3:
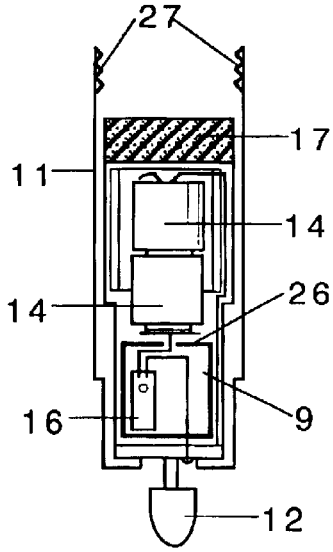
FIG. 3 is a schematic cross-sectional view of the illumination means, the power source and the invert switch of the disclosed device.

FIG. 3 provides an enlargement of the circuitry of the detection device 10, and in addition, shows the compression seal 17. This seal maintains the integrity of the electrical components and enhances the compression fit between the tether housing 18 and its tether line 25 and spool 22.

To recap, somewhat the alerting device 10 is typically attached to the belt 29 or other clothing item of the wearer. In FIG. 1, the pressure sensitive latch release 20 is hidden by the loop 30, but is attached to the alerting device by attachment means 31, which is, in turn, attached to loop 30, which engages and attaches to belt 29.

The water-tight housing 11, which is preferably attached to the tether housing 18 by a threaded relationship, can be fabricated from a variety of materials, but for convenience, it is currently molded from a thermoplastic material. To permit the light energy emitted from the illumination means (LED) to cast its beam from the device and in all directions therefrom, it is necessary, of course, that a significant portion of the housing encasing the LED 12 be translucent. In a preferred embodiment of the detection device 10, the light emitting end of the device will feature a light-enhancing lens 13 that can be easily fabricated and permanently attached to the housing 11.

While the foregoing is a detailed and complete description of the preferred embodiment of the disclosed detection device, it should be apparent that numerous variations and modifications can be made and employed to implement the essential purpose of the device without departing from the spirit of the invention, which is fairly defined by the appended claims.

I claim:

1. A device to be worn by an individual engaged in maritime, coastal, inland water or aquatic activity to aid in the detection of the unconscious submerged body of said individual in the event of a mishap, said device comprising the following elements:

an illumination means;

a power source in electrical communication with said illumination means;

an invert switch to control the electrical communication between said power source and said illumination means; and a water-tight housing encasing said elements, said housing having a clasp engaged with a pressure-sensitive releasing means self-activated when a predetermined water pressure is reached attachable to said individual and tethered to said water-tight housing by a line of predetermined length.

2. The device according to claim 1 wherein the water-tight housing comprises a translucent portion to allow the illumination means to cast a beam of light from said device.

3. The device according to claim 1 wherein the illumination means is an LED.

4. The device according to claim 1 wherein the power source is a battery.

5. The device according to claim 1 wherein the pressure-sensitive releasing means is an elastomeric bulb containing a silicone fluid.

6. The device according to claim 1 wherein the line of predetermined length is a mono-filament tether line.

* * * * *